US006158689A

United States Patent [19]

Mayer et al.

[11] Patent Number: 6,158,689

[45] Date of Patent: Dec. 12, 2000

[54] YARN WINDING APPARATUS AND METHOD

[75] Inventors: Manfred Mayer, Remscheid; Siegfried Behnert, Gornau; Peter Kroll, Chemnitz; Hans-Jochen Busch, Remscheid; Siegfried Theilig, Chemnitz; Volker Roland, Amtsberg, all of Germany

[73] Assignee: Barmag-Spinnzwirn GmbH, Chemnitz, Germany

[21] Appl. No.: 09/480,475

[22] Filed: Jan. 10, 2000

Related U.S. Application Data

[63] Continuation of application No. PCT/EP98/04156, Jul. 6, 1998.

[30] Foreign Application Priority Data

Jul. 10, 1997 [DE] Germany ..... 197 29 536

[51] Int. Cl.[7] ..... B65H 67/044

[52] U.S. Cl. ..... 242/476.4; 242/482.1; 242/481.9; 242/474.5

[58] Field of Search ..... 242/474.5, 474.6, 242/475.7, 476.4, 481.9, 481.8, 486.1, 482, 482.1, 482.2, 477.4

[56] References Cited

U.S. PATENT DOCUMENTS

| | | | |
|---|---|---|---|
| 3,136,495 | 6/1964 | Furst | 242/482.1 |
| 3,270,971 | 9/1966 | Jenny | 242/482.1 |
| 3,276,703 | 10/1966 | Kamp | 242/482.1 |
| 3,279,713 | 10/1966 | Furst | 242/482.1 |
| 3,797,767 | 3/1974 | Schippers et al. . | |
| 3,908,917 | 9/1975 | Tschentscher | 242/476.4 |
| 3,982,706 | 9/1976 | Delerue | 242/477.4 |
| 3,999,715 | 12/1976 | Schippers et al. . | |
| 4,216,920 | 8/1980 | Tambara et al. . | |
| 4,431,138 | 2/1984 | Schiminski et al. | 242/474.6 |
| 4,491,282 | 1/1985 | Hübner . | |
| 4,917,319 | 4/1990 | Lenk . | |
| 4,948,058 | 8/1990 | Behrens et al. . | |
| 4,969,607 | 11/1990 | Busenhart et al. | 242/474.5 |

(List continued on next page.)

FOREIGN PATENT DOCUMENTS

| | | |
|---|---|---|
| 0 650 914 A1 | 5/1995 | European Pat. Off. . |
| 0 703 179 A2 | 3/1996 | European Pat. Off. . |
| 23 64 284 | 11/1975 | Germany . |
| 38 31 341 A1 | 4/1989 | Germany . |
| 195 20 285 C1 | 6/1996 | Germany . |
| 6-247624 | 9/1994 | Japan . |
| 81214512 | 5/1993 | Taiwan . |
| 85212163 | 5/1997 | Taiwan . |

OTHER PUBLICATIONS

Japanese patent abstract for JP6–247624.

*Primary Examiner*—Donald P. Walsh
*Assistant Examiner*—Collin A. Webb
*Attorney, Agent, or Firm*—Alston & Bird LLP

[57] ABSTRACT

A yarn winding machine for winding a continuously advancing yarn into packages, the yarn being guided in a yarn traversing mechanism which includes a traversing unit and a grooved roll downstream thereof in the direction of the advance of the yarn. To transfer the yarn from a full package mounted on one winding spindle to an empty tube mounted on another winding spindle, the spindle mounting the full yarn package is moved to a doffing position and the spindle mounting the empty winding tube is moved to the winding position. The machine is provided with a yarn deflection device, which comprises a guide plate extending parallel to the circumference of the grooved roll, and a yarn guide adapted for movement in a direction parallel to the winding spindles. By rotating the guide plate, the yarn can be removed from the traversing mechanism without significantly changing its looping, and the yarn guide is then adapted to engage the advancing yarn and move the yarn into engagement with a yarn catching slot on the empty winding tube.

14 Claims, 4 Drawing Sheets

U.S. PATENT DOCUMENTS

| | | | |
|---|---|---|---|
| 5,016,829 | 5/1991 | Schippers et al. | 242/474.6 |
| 5,143,313 | 9/1992 | Ohashi | 242/481.8 |
| 5,228,630 | 7/1993 | Nakai et al. | 242/474.5 |
| 5,779,170 | 7/1998 | Siepmann et al. | 242/473.8 |
| 5,954,289 | 9/1999 | Hermanns et al. | 242/481.8 X |
| 6,024,320 | 2/2000 | Schippers et al. | 242/481.7 |
| 6,042,044 | 3/2000 | Gorke et al. | 242/474.5 |
| 6,045,081 | 4/2000 | Oberstrass et al. | 242/473.8 |
| 6,053,449 | 4/2000 | Wolf et al. | 242/474.5 |
| 6,070,827 | 6/2000 | Spahlinger et al. | 242/474.5 |
| 6,076,760 | 6/2000 | Mayer | 242/474.5 |

YARN WINDING APPARATUS AND METHOD

CROSS-REFERENCE TO RELATED APPLICATIONS

This application is a continuation of pending PCT International Application PCT/EP98/04156, filed Jul. 6, 1998, designating inter alia the United States.

BACKGROUND OF THE INVENTION

The invention relates to a yarn winding apparatus and method for winding a continuously advancing yarn into yarn packages.

A yarn winding machine of the described type is known from DE 23 64 284 and corresponding to U.S. Pat. No. 3,999,715. In that machine, a continuously advancing yarn is wound to a package. After the package is fully wound, the yarn is automatically changed from the full package to an empty tube. In this process, the yarn is guided by a yarn transfer device in such a manner that it is received by the empty tube. To this end, the full yarn package and the empty tube are mounted on respective winding spindles, which are arranged in cantilever fashion for rotation on a spindle turret. To transfer the yarn, the full package is rotated from a winding position to a doffing position and the empty tube from the doffing position to the winding position by rotating the spindle turret. Further, to transfer the yarn, it is necessary to lift the yarn by means of the yarn transfer device out of a yarn traversing mechanism. This yarn traversing mechanism comprises a traversing unit and a grooved roll. The grooved roll is arranged directly upstream of the package being wound and is partially looped by the yarn. For depositing the yarn on the package, the yarn is guided in a yarn guide groove in the roll.

Consequently, the known yarn transfer device guides the yarn by means of a yarn guide in a wide loop outside of the yarn traversing mechanism. Such great deflections generate correspondingly high yarn tensions. These yarn tensions may lead to a breakage of the yarn before it is caught on the empty tube.

It is accordingly the object of the invention to further develop a winding machine of the initially described type in such a manner that the yarn is transferred from the full package to the empty tube as gently as possible, so that during the transfer, the yarn tension undergoes a smallest possible fluctuation.

SUMMARY OF THE INVENTION

The above and other objects and advantages of the invention are achieved by the provision of a winding apparatus and method which comprises a turret mounting at least two winding spindles having parallel axes, and means for sequentially rotating the turret so that each of the winding spindles may be alternatively moved between a winding position and a doffing position. A yarn traversing system includes a grooved roll mounted on an axis parallel to the axes of the winding spindles, and a traversing unit mounted upstream of the grooved roll for laterally traversing the advancing yarn and guiding the same into the groove of the grooved roll. Also, a yarn transfer mechanism is provided which is operable upon the turret moving a rotating full yarn package from the winding position to the doffing position and moving an empty winding tube to the winding position, for transferring the advancing yarn from the rotating full yarn package to the empty winding tube. The yarn transfer mechanism comprises a guide plate moveable about the circumference of the grooved roll and between an idle position removed from the advancing yarn and an operating position located between the surface of the grooved roll and the advancing yarn and so as to deflect the advancing yarn from yarn traversing system. Also, a yarn guide is mounted for movement along a direction parallel to the axes of the winding spindles between an idle position and a catching position wherein the advancing yarn is guided into a yarn catching slot in the empty winding tube.

The winding machine of the present invention is characterized by the fact that it approximately maintains during a transfer of the yarn the degree of looping which the yarn assumes while being traversed on the grooved roll. Thus, during a transfer of the yarn from the full package to the empty tube, the tensions generated in the yarn by friction are insignificantly changed in comparison with the yarn tensions during a winding cycle.

The yarn transfer device of the takeup machine in accordance with the invention can advantageously be used for an initial threadup of the yarn on an empty tube and during a transfer of the yarn from a full package to an empty tube.

The guide plate of the yarn transfer mechanism preferably is in the form of an arcuate plate having a curvature which is congruent with the circumference of the grooved roll and a length extending over the traverse stroke provided by the yarn traversing system. This construction has the advantage that the looping of the yarn about the grooved roll and the looping of the yarn about the guide plate are essentially the same. At the same time, the guide plate serves as a cover of the grooved roll. In this connection, the guide plate may be constructed such that the region of the grooved roll which is not contacted by the yarn, is completely covered in the idle position of the guide plate. This prevents air turbulences that are generated by the grooved roll, so that while being traversed the yarn can be reliably guided in the yarn guide groove of the grooved roll.

In one embodiment, the guide plate includes a guide surface which initially engages the advancing yarn at a location between the traversing unit and the grooved roll as the guide plate moves from its idle position to its operating position. This allows a particularly gentle takeover of the yarn from the yarn traversing mechanism to be realized. To this end, the direction of movement of the guide plate is identical with the direction of the advancing yarn. In this arrangement, the yarn is initially removed from the traversing unit during the movement of the guide plate, which is especially advantageous in the case of a grooved roll which has a yarn guide groove only in the end regions of the traverse stroke.

In the case of a grooved roll having circumferential yarn guide grooves over the entire traverse stroke, it is preferred to use an embodiment of the takeup machine wherein the guide plate includes a guide surface which initially engages the advancing yarn at a location downstream of the grooved roll as the guide plate moves from its idle position to its operating position. In this arrangement, the yarn is initially disengaged from the grooved roll. This allows the yarn to follow without interference the traversing movement of the traversing unit by sliding along the guide surface of-the guide plate.

The winding spindles are preferably mounted on the turret so as to be axially moveable between an extended position and a withdrawn position, and such that the winding spindle in the doffing position assumes the extended position while the winding spindle in the winding position assumes the withdrawn position. This construction is suitable in particular for transferring the yarn from a full package to an empty tube. To this end, the full package is moved with its winding spindle to an outer position on the spindle turret, so that the empty tube and the full package are positioned offset from each other in the direction of the advancing yarn. This prevents the yarn from unwinding from the full package while being guided in the catching position. Until it is caught in a slot of the empty tube, the yarn is wound onto the full package. Furthermore, this embodiment of the takeup machine exhibits a very high threadup reliability. The yarn can be guided along a path parallel to the catching slot in the empty tube. As a result, the entire length of the catching slot is available for catching the yarn.

In this connection, it is preferred to use an embodiment of the takeup machine wherein the spindle mounting means includes cooperating cam surfaces for continuously moving each winding spindle from its withdrawn position to its extended position as it moves from the winding position to the doffing position, and for continuously moving each winding spindle from its extended position to its withdrawn position as it moves from the doffing position to the winding position. This construction renders it possible to deposit the yarn already removed from the yarn traversing mechanism without winding a tie-off bead on the full package. Only when the full package is displaced to its outer position, is a tie-off bead wound on the full package. A further advantage of this embodiment lies in that no additional drives means are needed for displacing the winding spindle.

However, to prevent the yarn from dropping off the full package, it is also possible to move during a yarn transfer a threadup plate into the region between the empty tube and the full package, so that the yarn guided in a guide groove advances to a specific position on the full package, and thus forms a tie-off bead. After the yarn is received in the guide groove between the empty tube and the full package, the yarn guide moves to the catching position, so that the yarn advances onto the empty tube in the region of the catching slot and can be taken over by the empty tube.

A further, especially advantageous variant of the takeup machine provides that the spindle turret is rotatable opposite to the direction of rotation of the winding spindle. Thus during the yarn catching, the empty tube moves oppositely to the direction of the advancing yarn. The relative movement between the empty tube and the yarn results in that during the catching the empty tube generates very rapidly the necessary clamping forces for building up a yarn tension, which causes the yarn to be severed in the partial length between the empty tube and the full package. On the other hand, this arrangement permits the looping about the empty tube to be kept very low, which is necessary for catching the yarn, so as to prevent sudden fluctuations of the tension in the yarn, when the empty tube is swung into the yarn path.

In another embodiment, each of the winding spindles are driven in a common rotational direction, and the means for sequentially rotating the turret acts to rotate the turret in a direction opposite the common rotational direction of the spindles. A threadup plate may also be provided which is pivotably mounted for movement between and idle position and an operating position wherein the plate is disposed between the winding spindles. A guide edge on the plate is then positioned to engage the yarn as it advances between the empty winding tube and the full yarn package during the yarn transfer operation. It is thus possible to minimize the looping of the yarn about the empty tube in the winding range. Only after the yarn is moved to the catching position, is the threadup plate pivoted into the yarn path between the empty tube and the full package, so that the guide edge deflects the yarn. This allows the looping of the yarn about the empty tube to be adjusted, which is necessary for catching.

The threadup plate preferably has a length covering at least the length of the full package on the winding spindle at the doffing position. This threadup plate moves from its idle position to its operating position in a direction which is common with the direction of movement of the adjacent surface of the rotating full yarn package. This prevents the loose yarn end of the full package from reaching the region of the package being newly wound. To this end, the pivoting direction of the threadup plate and the rotational direction of the full package in the doffing range are unidirectional. This prevents the loose yarn end from striking the guide edge of the threadup plate.

BRIEF DESCRIPTION OF THE DRAWINGS

Some of the objects and advantages of the present invention having been stated, others will appear as the description proceeds, when considered in conjunction with the accompanying drawings, in which.

DETAILED DESCRIPTION OF THE PREFERRED EMBODIMENTS

Figure 1:
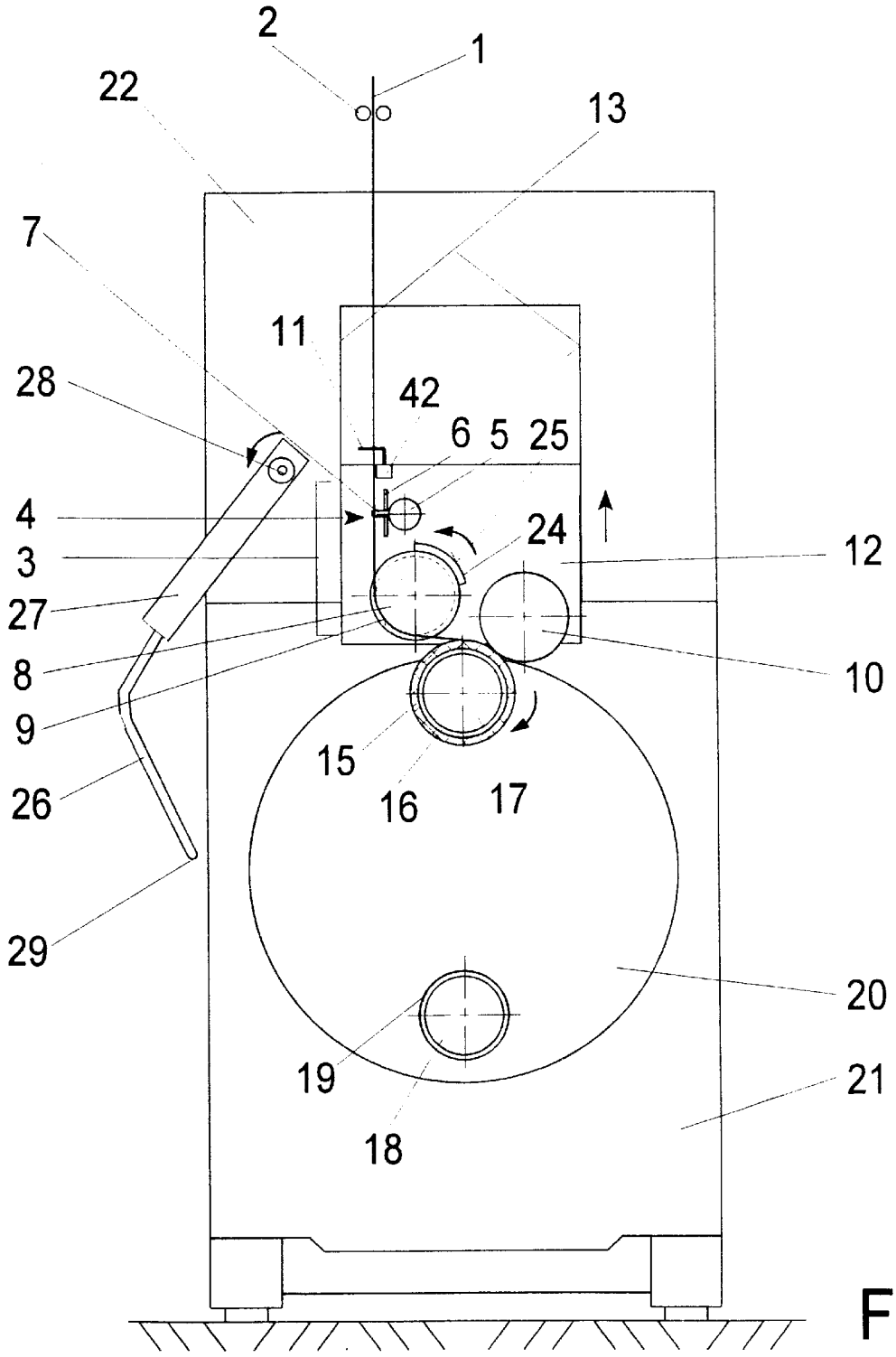
FIG. 1 is a schematic side view of a takeup machine according to the invention in operation.

In all embodiments of the illustrated takeup machine, a yarn 1 advances continuously at a constant speed to the takeup machine. Initially, the yarn 1 advances through a yarn guide 2 which forms the apex of a traversing triangle. Thereafter, the yarn reaches a traversing mechanism 3. The traversing mechanism 3 consists of a traversing unit 4 and a grooved roll 8 downstream thereof in the path of the yarn. Such a traversing mechanism is disclosed, for example, in U.S. Pat. No. 3,797,767. The traversing unit 4 is formed preferably by a cross-spiralled roll 5 and a yarn guide 7 traversing in a straight guideway 6. To this end, the traversing yarn guide 7 engages a groove of the cross-spiralled roll 5, and it is caused to reciprocate by the driven cross-spiralled roll 5. The grooved roll 8 is provided on its circumference with yarn guide grooves 9. Since the cross-spiralled roll 5 and the grooved roll 8 are driven at a synchronous peripheral speed, the traversing yarn guide 7 serves to guide the yarn in the yarn guide groove 9. The cross-spiralled roll 5 is adapted to the grooved roll 8 such that the traversing yarn guide 7 reliably guides the yarn with an adequate overfeed into the yarn guide groove 9. The yarn guide groove 9 assumes the actual depositing of the yarn 1 on a package 15. In so doing, the yarn 1 is deflected on the circumference of grooved roll 8 by about 90°, and subsequently advances onto the package 15. To secure the deposited yarn, a contact roll 10 is arranged on an axis parallel to the grooved roll 8, and it rests under a predetermined contact force against the surface of the package 15.

The yarn traversing mechanism 3 and contact roll 10 are arranged on a vertically adjustable carriage 12. The carriage 12 is vertically reciprocated by a pneumatic pressure relieving device (not shown) in a guideway 13. The pneumatic pressure relieving device is biased with compressed air in such a manner that it compensates in full or in part for the carriage weight and, if need be, generates an additional contact force between contact roll 10 and the package resting thereagainst. Such a pressure relieving device may also be controlled via a programmable control device in such a manner that the contact force is operative between the contact roll 10 and the package 15 in a pattern that is predetermined for the winding cycle.

Figure 3:
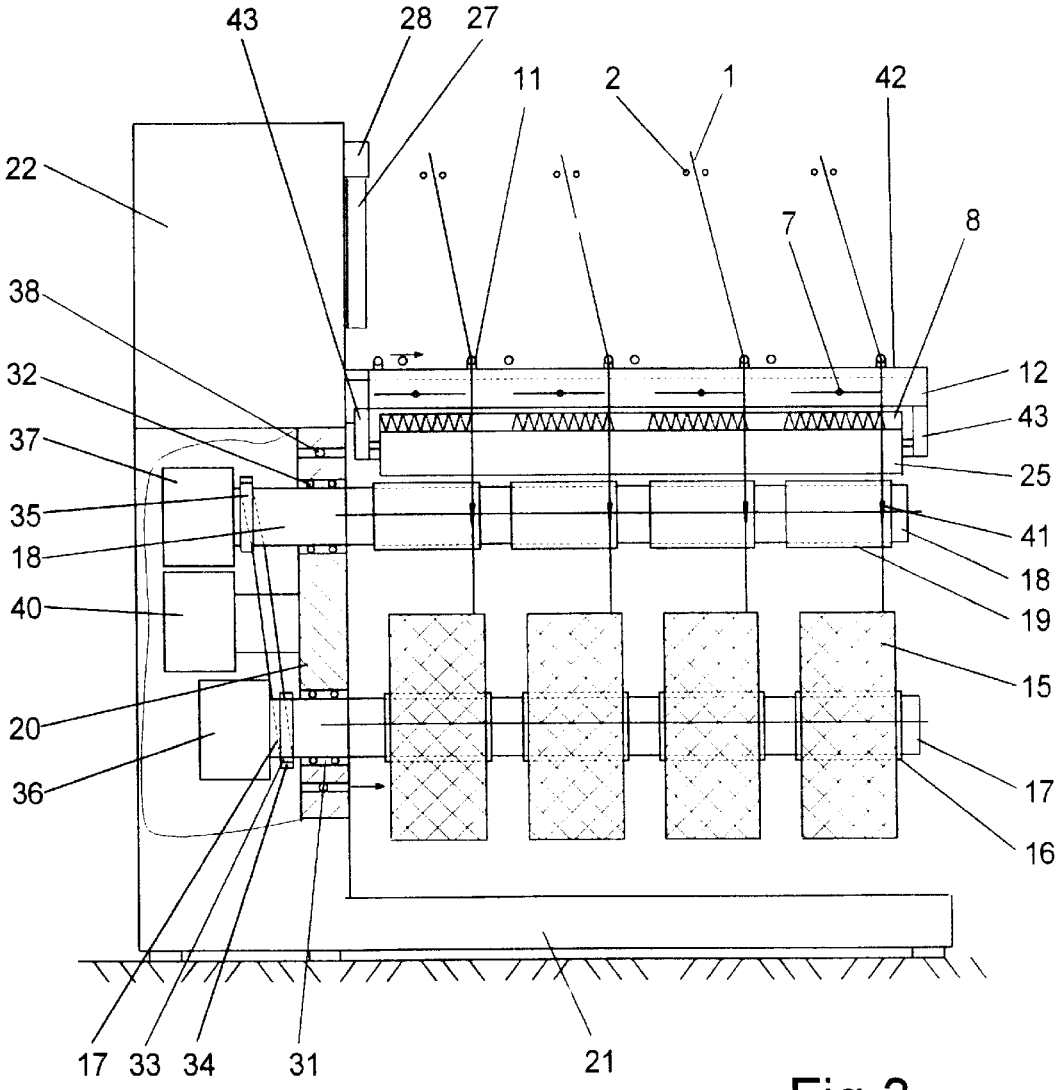
FIG. 3 is a schematic front view of the takeup machine of FIG. 1 during a yarn transfer.

The package 15 is wound on a tube 16. The tube 16 is mounted on a rotatably supported winding spindle 17. The package 15 is driven by the winding spindle 17 that is connected to a spindle drive 36 (FIG. 3). However, the package 15 can also be driven on its circumference by the contact roll 10.

In FIG. 1, the winding spindle 17 with tube 16 mounted thereon and the package 15 wound on the latter is in the winding range. At this time, a second winding spindle 18 with an empty tube 19 mounted thereon is in a doffing range. Both winding spindles 17 and 18 are mounted in cantilever fashion for free rotation in a rotatable spindle turret 20. The spindle turret 20 is supported for rotation in a machine frame 21 of the takeup machine, and it is rotatable by a turret drive 40 (FIG. 3), so that it is possible to rotate the winding spindles 17 and 18 alternately into the winding range and doffing range, when the package 15 is fully wound on one of the spindles. To this end, the spindle turret 20 is connected to the turret drive 40 (FIG. 3).

To enable the increase in the diameter of package 15 during a winding cycle in the winding range, the contact roll 10 and the yarn traversing mechanism 3 are removed in the vertical direction by carriage 12. This movement is controlled by the pressure relieving device (not shown).

To thread the yarn on an empty tube or to transfer the yarn from a full package to an empty tube, the takeup machine is provided with a yarn deflection device. The yarn deflection device consists of a guide plate 24 which is arranged for movement on the circumference of grooved roll 8. Furthermore, the yarn deflection device comprises a yarn guide 11 arranged in the yarn path upstream of the yarn traversing mechanism 3. This yarn guide 11 can be positioned by means of a positioning device 42 along an axis parallel to the winding spindles 17 and 18. FIG. 1 shows the takeup machine in its operating position. The guide plate 24 is in its idle position. In this position, the region of the grooved roll 8 that is not contacted by the yarn is totally or partially covered by the guide plate 24. Likewise, the yarn guide 11 is in its idle position outside of the traversing triangle.

During a first threadup, the winding spindle 17 with tube 16 thereon is moved, as shown in FIG. 1, by the rotation of spindle turret 20 to the illustrated position in the winding range. Subsequently, the carriage 12 moves downward to cause the contact roll 10 to come into contact with the tube 16. The tube 16 is driven by means of the winding spindle 17, so that upon contacting the tube 16, the contact roll 10 assumes the same circumferential speed. Subsequently, the guide plate 24 is moved counterclockwise in the direction indicated by an arrow into the yarn path between the pretraversing unit 4 and the grooved roll 8. In this process, the yarn is contacted by the guide surface 25 of guide plate 24, and removed from the traversing yarn guide 7 as well as from the yarn guide groove 9 of the grooved roll. Thus, the yarn leaves the traversing mechanism. It is placed with a threadup gun around the guide plate 24 and guided between the empty tube 16 and the empty tube 19. In so doing, the yarn will assume its natural direction of advance, so that it is located in the center region of the tube 16. The direction of advance of yarn 1 is oppositely directed to the direction of movement of the empty tube 16 as indicated by an arrow. Now, the yarn guide 11 is pivoted by means of positioning device 42 from an idle position to a catching position. In so doing, the yarn guide 11 receives yarn 1, and guides same along guide surface 25 to the catching position. The catching position is outside of the traverse range. In this position, the yarn guide 11 is located in a normal plane with a catching slot provided in the tube 16. By having an operator guide the threadup gun, it is now possible to increase the looping of yarn 1 about the empty tube 16 in such a manner that the yarn is caught in the slot of the empty tube 16.

However, it is also possible to predetermine a certain looping of the yarn 1 about tube 16. To this end, use is made of a threadup plate 26 arranged on the side of the machine frame. The threadup plate 26 is mounted on one end of a rocker arm 27. With its other end, the rocker arm 27 is supported for pivotal movement about an axis of rotation 28 arranged in an upper machine frame 22. The rocker arm 27 can be pivoted by a drive (not shown) such that the threadup plate 26 is able to enter into the region of spindle turret 20. Thereafter, the threadup plate 26 is pivoted between the tube 16 and empty tube 19. In so doing, a guide edge 29 of the threadup plate 26 deflects the yarn 1 such that the yarn 1 loops about tube 16. When the threadup plate 26 is in its operating position, and the yarn guide 11 is moved into the catching position, the yarn will be caught in the slot of tube 16.

After the yarn is caught in the slot of tube 16, the yarn guide 11 is moved such that a yarn reserve can be wound on tube 16. After winding the yarn reserve, the yarn guide 11 returns to its starting position. At the same time, the guide plate 24 is pivoted to its idle position, so that the yarn drops into the yarn traversing mechanism and is received by traversing yarn guide 7 and yarn guide groove 9. The threadup plate 26 is also returned to its idle position. The winding cycle for forming the package 15 starts.

During the winding cycle, the rotational speed of winding spindle 17 is controlled by means of a control device in such a manner that the circumferential speed of the package 15 remains constant. To this end, the rotational speed of the contact roll 10 is detected and supplied to a control device. As soon as the rotational speed of contact roll 10 changes, the drive 36 of spindle 17 is adjusted via the control device, so that the circumferential speed of the contact roll readjusts to its desired value.

While threading the yarn, it is also possible that the yarn guide 11 transfers the yarn at the end of the traverse stroke to a yarn reserve device. The yarn reserve device guides the yarn during the catching and during the winding of the yarn reserve. Subsequently, the yarn reserve device releases the yarn.

Figure 2:
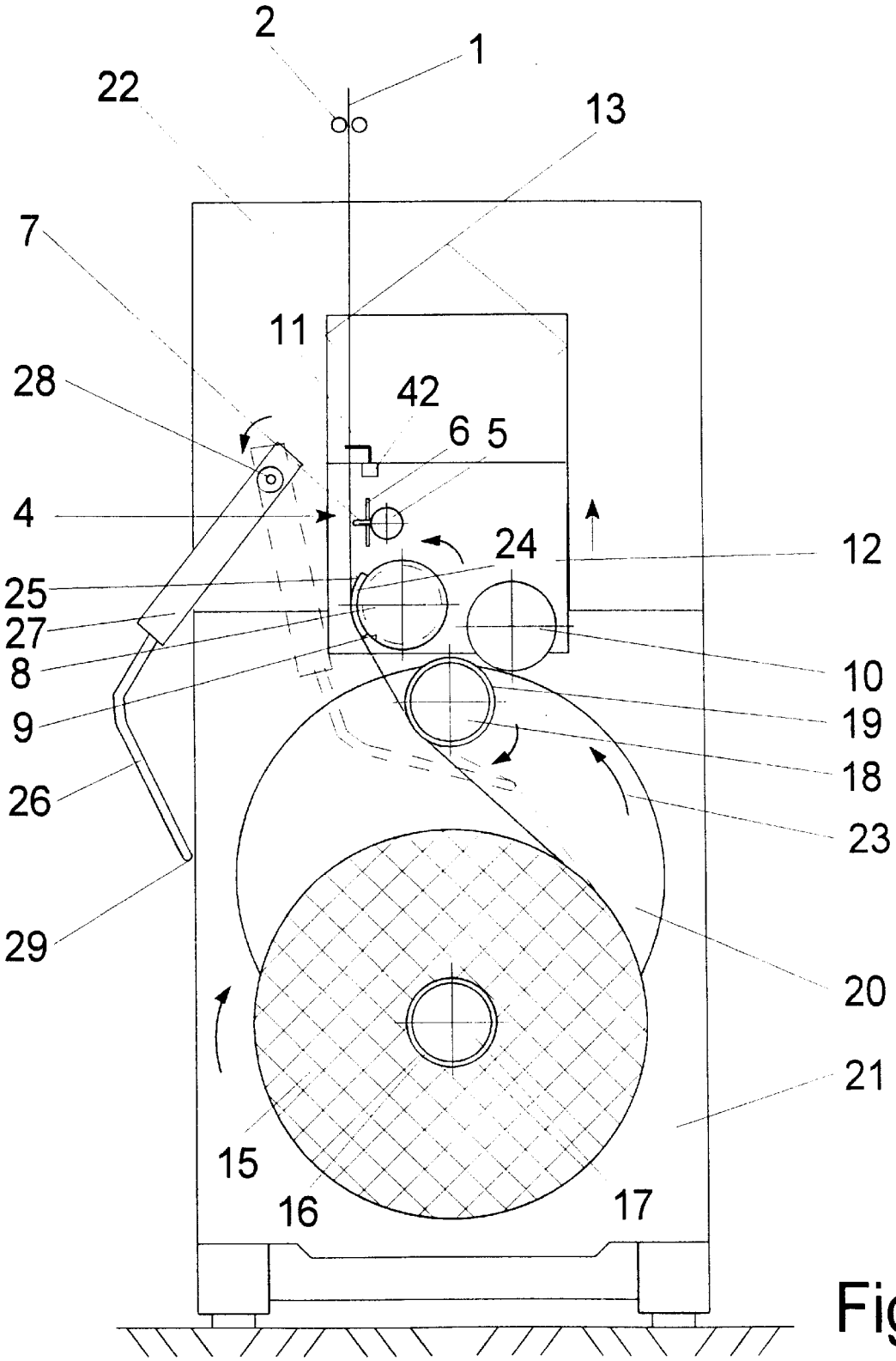
FIG. 2 is a side view of the takeup machine of FIG. 1 during a yarn transfer.

Shown in FIG. 2 is the situation during the transfer of the yarn from the full package to an empty tube. After the package 15 is fully wound, the carriage 12 moves to its highest position. The spindle turret 20 is rotated counterclockwise in the direction of rotation 23. After the full package 15 has left the region of the grooved roll 8, the carriage 12 is lowered. The guide plate 24 is now pivoted from its idle position to its operation position. To this end, the guide plate 24 is connected to a rocker arm 43, which is arranged for pivotal movement on carriage 12 (FIG. 3). Subsequently, the guide surface 25 of guide plate 24 removes the yarn 1 from the traversing yarn guide 7 of pretraversing unit 4 and from the yarn guide groove 9 of grooved roll 8. The yarn 1 assumes its natural direction of advance, which is about in the middle of the package 15. Thus, a first tie-off bead is wound.

When rotating the spindle turret 20, the winding spindle 17 with the full package is moved in an axial direction from an inner position to an outer position on the spindle turret 20, as is described in more detail below with reference to FIG. 3. The outer position is reached, when the winding spindle 17 with full package 15 has reached the doffing range, as shown in FIG. 2. The winding spindle 18 with empty tube 19 and the winding spindle 17 with full package 15 are arranged offset from each other on the spindle turret 20.

FIG. 3 is a front view of the situation shown in FIG. 2. The embodiment of the takeup machine, as shown in FIG. 3, comprises by way of example a plurality of winding positions—shown are four winding positions. Each of the winding positions is identically constructed, so that the description will continue, as before, with reference to one winding position.

The winding spindles 17 and 18 are mounted with spindle bearings 31 and 32 for displacement in the spindle turret 20. The spindle turret 20 is supported with bearing 38 in the machine frame 21. On the side of the spindle turret 20 that faces the winding positions, the winding spindle 17 is connected to a spindle drive 36, and the winding spindle 18 to a spindle drive 37. In the region of drive 36 and bearing 31, the winding spindle 17 mounts a cam 33. The cam 33 engages a groove 34 provided in the machine frame. The groove 34 is peripherally arranged in the machine frame. Preferably the groove extends in part inclined with respect to the vertical. Thus, the winding spindle 17 with cam 33 is moved relative to winding spindle 18, which also has a cam 35 engaging groove 34, in axial direction from an inner to an outer position on the spindle turret.

The following description concerning the transfer of the yarn applies both to FIG. 2 and to FIG. 3. After the winding spindle 17 with the full package 15 has reached its position in the doffing range, the yarn guide 11 is moved by a positioning device 42 from its idle position to a catching position. In so doing, the yarn engages yarn guide 11 and slides along the guide surface 25 of guide plate 24. In this position, a further tie-off bead is wound on the full package 15. The empty tube 19 on winding spindle 18 is only slightly looped by the yarn 1. A catching in this situation is not possible. Only after the threadup plate 26 has been moved from its idle position to its operating position, as shown in dashed lines in FIG. 2, will the looping of yarn 1 about tube 19 be increased in such a manner that the yarn 1 immerses into the catching slot 41 of empty tube 19 and is caught therein. In FIG. 3, the threadup plate 26 in not shown for the sake of clarity. Thereafter, the yarn tears in its length between the full package 15 and the empty tube 19. The threadup plate 26 is designed and constructed such that the entire length of full package 15 is covered. Thus, the loose yarn end of the full package 15 is unable to come into the region of empty tube 19.

After the yarn 1 is caught on the empty tube 19, the yarn guide 11 is positioned such that a yarn reserve can be wound on the tube. Once the yarn reserve is wound, the guide plate 24 and yarn guide 11 return to their initial position. With that, the yarn 1 is released and returned to the regions of the yarn guide groove 9, grooved roll 8, and traversing yarn guide 7 of the pretraversing unit 4. A new winding cycle starts.

The winding spindle 17 with full package 15 thereon is braked, so that the full package is ready for removal. After the full package 15 is removed from the spindle 17, the threadup plate 26 swings back to its starting position. One or more new empty tubes are mounted on winding spindle 17.

Likewise, when transferring the yarn, it is possible to guide the yarn by means of yarn guide 11 and a yarn reserve device arranged outside of the traverse stroke. In this process, the yarn is removed by yarn guide 11 from the range of the traverse stroke only for its transfer to the yarn reserve device. The positioning for catching and for winding the yarn reserve is handled by the yarn reserve device.

In its catching position, the yarn advances parallel through the catching slot 41 of empty tube 19. Both the parallel yarn advance and the opposite directions of movement of yarn 1 and empty tube 19 lead to a very high catching reliability.

Figure 4:
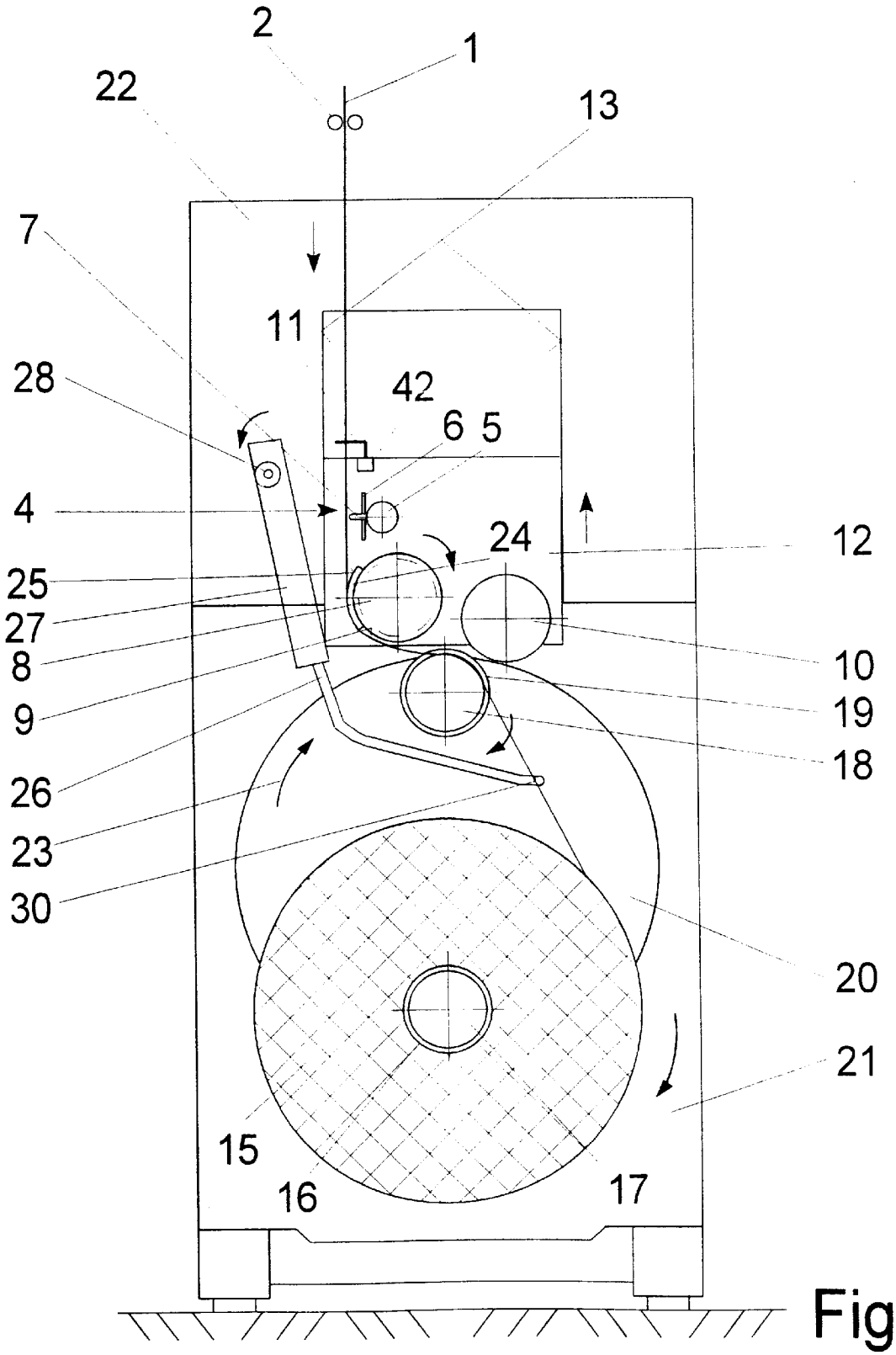
FIG. 4 is a schematic side view of a further embodiment of the takeup machine.

FIG. 4 is a side view of a further embodiment of the takeup machine in accordance with the invention. Its construction is substantially identical with the construction of the takeup machine of FIG. 1. Other than in the takeup machine of FIG. 1, in the takeup machine as shown in FIG. 4 the guide plate 24 is arranged such that its direction of movement for rotating into an operating position occurs clockwise.

The winding spindles 17 and 18 are mounted for nonrotation on the spindle turret 20. Likewise, the direction of rotation of the spindle turret is the same as the direction of rotation of the winding spindles. Consequently, when transferring the yarn from the full package 15 to the empty tube 19, the winding spindle 18 with empty tube 19 rotates into the yarn path such that the direction of rotation of tube 19 and the direction of the advancing yarn I are the same. In this arrangement, the empty tube 19 has in the winding range already a looping necessary for catching the yarn.

When transferring the yarn, carriage 12 moves first in its highest position, so that the spindle turret is able to move clockwise the full package 15 from the winding range to the doffing range. After positioning the full package 15 in the doffing range, the guide plate 24 is moved to its operating position, so that the guide surface 25 of guide plate 24 lifts the yarn out of guide groove 9 and traversing yarn guide 7. The yarn then advances again along its natural path onto the center region of the full package 15. Now, the threadup plate 26 is pivoted by means of rocker arm 27 between the empty tube 19 and the full package 15. The threadup plate 26 has a guide groove 30 facing the yarn, in which the yarn is caught. In this position, a tie-off bead is wound on the full package 15. Now, the yarn guide 11 moves from its idle position to the catching position. In so doing, the yarn 1 is removed from the range of the traverse stroke until it advances through a catching slot provided in the empty tube 19. After the yarn 1 is caught by the empty tube 19, a yarn reserve is wound. Subsequently the winding cycle starts. Likewise, in this embodiment of the takeup machine, the yarn is removed from the traversing mechanism, without significantly changing its looping in the region of the grooved roll.

That which is claimed:

1. An apparatus for continuously winding an advancing yarn onto winding tubes serially delivered to a winding position, comprising a turret mounting at least two winding spindles having parallel axes, and means for sequentially rotating the turret so that each of the winding spindles may be alternatively moved between a winding position and a doffing position, means for traversing the yarn across a winding tube mounted on a winding spindle at the winding position and while rotatably driving such winding spindle so as to form a yarn package, said yarn traversing means comprising a grooved roll mounted on an axis parallel to the axes of the winding spindles, and a traversing unit mounted upstream of the grooved roll for laterally traversing the advancing yarn and guiding the same into the groove of the grooved roll, and a yarn transfer mechanism which is operable upon the turret moving a rotating full yarn package from the winding position to the doffing position and moving an empty winding tube to the winding position, for transferring the advancing yarn from the rotating full yarn package to the empty winding tube, the yarn transfer mechanism comprising a guide plate moveable about the circumference of the grooved roll and between an idle position removed from the advancing yarn and an operating position located between the surface of the grooved roll and the advancing yarn and so as to deflect the advancing yarn from yarn traversing means, and further comprising a yarn guide mounted for movement along a direction parallel to the axes of the winding spindles between an idle position and a catching position wherein the advancing yarn is guided into a yarn catching slot in the empty winding tube.

2. The yarn winding apparatus as defined in claim 1 wherein the guide plate of the yarn transfer mechanism is in the form of an arcuate plate having a curvature which is congruent with the circumference of the grooved roll and a length extending over the traverse stroke provided by the yarn traversing means.

3. The yarn winding apparatus as defined in claim 2 wherein the guide plate includes a guide surface which initially engages the advancing yarn at a location between the traversing unit and the grooved roll as the guide plate moves from its idle position to its operating position.

4. The yarn winding apparatus as defined in claim 2 wherein the guide plate includes a guide surface which initially engages the advancing yarn at a location downstream of the grooved roll as the guide plate moves from its idle position to its operating position.

5. The yarn winding apparatus as defined in claim 1 further comprising means mounting the winding spindles on the turret such that the winding spindles are axially moveable between an extended position and a withdrawn position, and such that the winding spindle in the doffing position assumes the extended position while the winding spindle in the winding position assumes the withdrawn position.

6. The yarn winding apparatus as defined in claim 5 wherein the spindle mounting means includes cooperating cam surfaces for continuously moving each winding spindle from its withdrawn position to its extended position as it moves from the winding position to the doffing position, and for continuously moving each winding spindle from its extended position to its withdrawn position as it moves from the doffing position to the winding position.

7. The winding apparatus as defined in claim 1 further comprising a threadup plate having a guide groove formed in one edge thereof, and means mounting said threadup plate for movement between an idle position and an operating position wherein the plate is disposed between the winding spindles and the guide groove is positioned to engage the yarn as it advances between the empty winding tube and the full yarn package during the yarn transfer operation.

8. The winding apparatus as defined in claim 1 further comprising drive means for rotatably driving each of the winding spindles in a common rotational direction, and wherein the means for sequentially rotating the turret acts to rotate the turret in a direction opposite said common rotational direction.

9. The winding apparatus as defined in claim 8 further comprising a threadup plate having a substantially straight guide edge, and means mounting said threadup plate for movement between and idle position and an operating position wherein the plate is disposed between the winding spindles and the guide edge is positioned to engage the yarn as it advances between the empty winding tube and the full yarn package during the yarn transfer operation.

10. The winding apparatus as defined in claim 9 wherein the threadup plate has a length covering at least the length of the full package on the winding spindle at the doffing position, and wherein the threadup plate is pivotally mounted for movement between said idle and operating positions and such that the threadup plate moves from its idle position to its operating position in a direction which is common with the direction of movement of the adjacent surface of the rotating full yarn package.

11. The winding apparatus as defined in claim 1 further comprising a contact roll for engaging the surface of the package being formed at the winding position of the turret, and wherein said yarn traversing means and said contact roll are mounted on a carriage which is moveable in a direction away from the package being formed at the winding position of the turret as the package builds during the winding operation.

12. A method of continuously winding an advancing yarn onto winding tubes serially delivered to a winding position, and including the steps of winding the advancing yarn onto a rotating first winding tube at the winding position and including traversing the yarn at a location upstream of the winding position so as to form a cross wound package on the first winding tube, and wherein the traversing step includes positioning a grooved roll so as to contact the surface of the package being formed on the first winding tube and laterally traversing the yarn by engagement with a reciprocating traversing unit which is mounted upstream of the grooved roll and so as to guide the advancing yarn into the groove of the grooved roll, laterally moving the rotating first winding tube from the winding position and to a doffing position upon a full yarn package being formed, while laterally moving an empty second winding tube from the doffing position to the winding position, then transferring the advancing yarn from the rotating full yarn package to the empty second winding tube and including rotating the empty second winding tube and moving a guide plate to an operating position about the circumference of the grooved roll so as to separate the advancing yarn from the traversing unit and from the grooved roll, and then guiding the advancing yarn along the surface of the guide plate to a location aligned with a yarn catching slot in the rotating empty second winding tube and so that the advancing yarn is caught by the slot to thereby sever the yarn between the rotating full package and the rotating empty second winding tube and commence winding of the yarn onto the rotating empty second winding tube.

13. The method as defined in claim 12 wherein the guide plate is in the form of an arcuate plate having a curvature which is congruent with the circumference of the grooved roll and a length extending over the traverse stroke provided by the yarn traverse, and wherein the step of moving a guide plate to an operating position includes moving the guide plate about the circumference of the grooved roll from an idle position which is removed from the advancing yarn to the operating position.

14. The method as defined in claim 13 comprising the further subsequent step of winding the advancing yarn onto the rotating empty second winding tube at the winding position and including guiding the advancing yarn so as to be engaged by the traversing unit and moving the guide plate about the circumference of the grooved roll from the operating position to the idle position.

* * * * *